US005561952A

United States Patent [19]

Damron

[11] Patent Number: 5,561,952

[45] Date of Patent: Oct. 8, 1996

[54] COMBINATION SKYLIGHT/STATIC VENTILATOR

[75] Inventor: Matthew S. Damron, Detroit, Mich.

[73] Assignee: Tapco International Corporation, Plymouth, Mich.

[21] Appl. No.: 225,554

[22] Filed: Apr. 11, 1994

[51] Int. Cl.[6] ..... E04B 7/00; E04H 12/18

[52] U.S. Cl. ..... 52/198; 52/200; 454/199; 454/367

[58] Field of Search ..... 52/198, 199, 200; 454/199, 365, 368, 358, 367, 35; 285/42

[56] References Cited

U.S. PATENT DOCUMENTS

| | | | |
|---|---|---|---|
| 1,547,916 | 7/1925 | Hoffman | 454/199 |
| 2,806,419 | 9/1957 | Artis | 454/199 |
| 3,085,490 | 4/1963 | Field | 454/199 X |
| 3,685,426 | 8/1972 | Rosa | 52/200 X |
| 4,389,453 | 8/1983 | Wilkerson | 454/367 |
| 4,593,504 | 6/1986 | Bonnici et al. | 52/199 |

FOREIGN PATENT DOCUMENTS

| | | | |
|---|---|---|---|
| 1017229 | 1/1966 | United Kingdom | 52/200 |

*Primary Examiner*—Kien T. Nguyen

[57] ABSTRACT

An improved roof ventilator is disclosed for venting an attic space while simultaneously admitting sunlight into same. One version of the invention comprises a base/flange having a centrally extruding conduit therethrough, a louvered hood member connectable to the conduit wall to achieve a fixed elevation thereby creating a baffle which restricts water infiltration. The hood further comprises a translucent oriel which is self-aligning to the conduit opening upon the installation of the hood to the base/flange. Another version of the invention comprises the oriel of the hood and the base/flange conjoined with a trim collar to form a skylight only. Used in pairs, the first skylight member is installed to the exterior of a pitched roof with the trim collar elevated within the roof structure. The second member, having a smaller diameter trim collar, is installed from the interior and mated to the first member whereas both collars telescopingly communicate to adapt to the various thicknesses of roof structures. The interior member is then rigidly fastened to the ceiling thereby self-aligning both oriels for the admittance of sunlight into a finished living space.

5 Claims, 6 Drawing Sheets

FIG. 4.
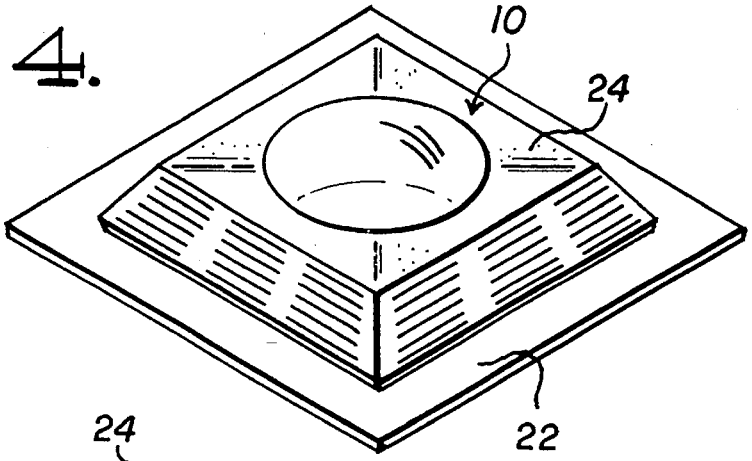
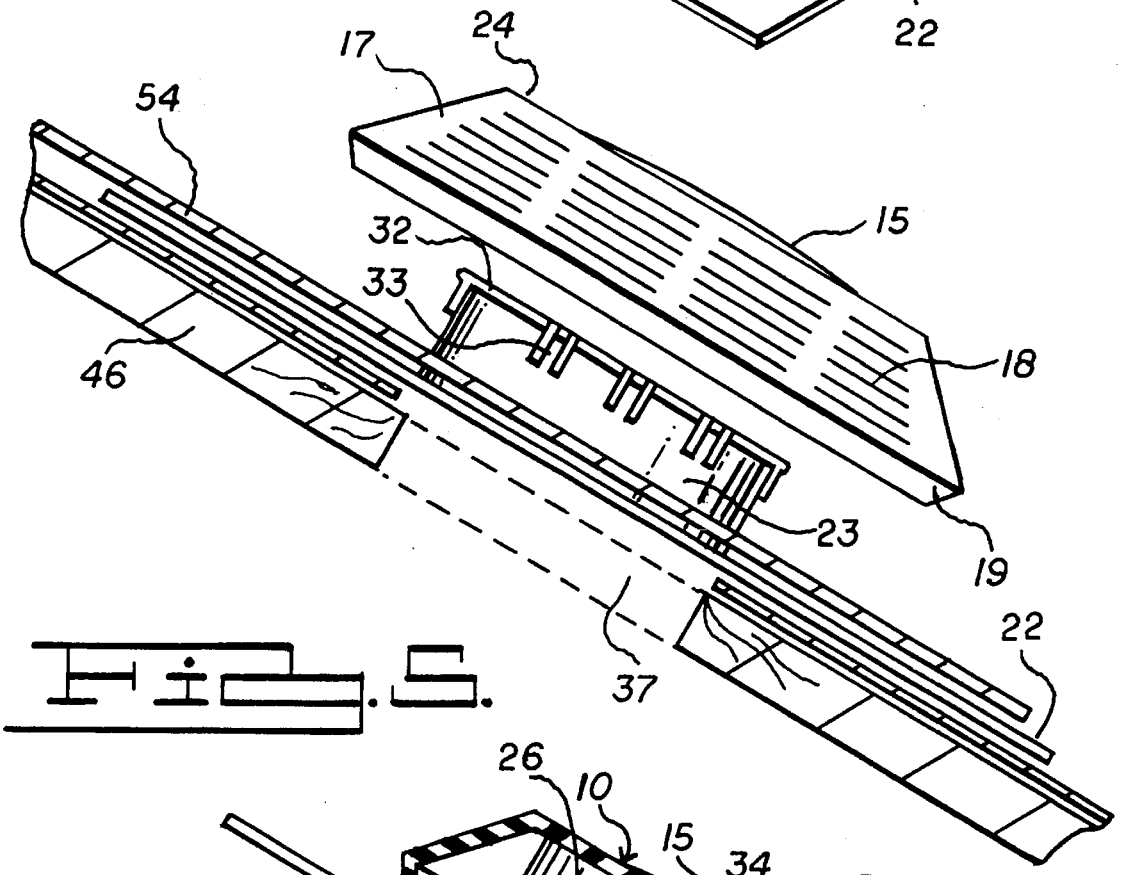
FIG. 5.
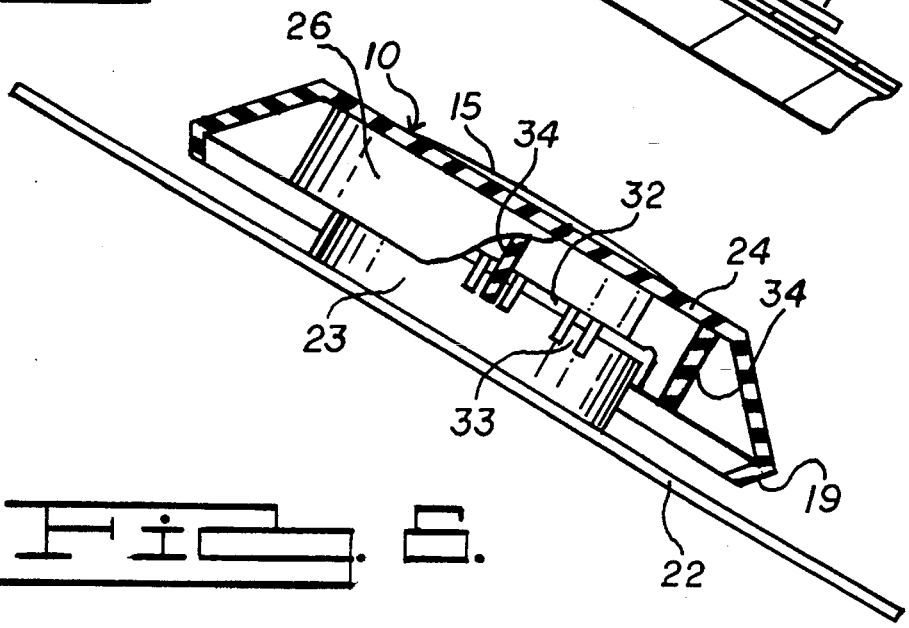
FIG. 6.

COMBINATION SKYLIGHT/STATIC VENTILATOR

TECHNICAL FIELD

This invention relates in general to building products used on a pitched roofing surface to facilitate static ventilation of an attic space. The invention also relates to the passive admittance of sunlight into said attic space.

BACKGROUND OF THE INVENTION

In most structures where a layer of insulation separates the living space from the attic space, a static roof ventilator (more commonly referred to as a "pot vent") is incorporated into the roof deck to dissipate moisture and vapor from the attic space to the outside of the dwelling. The moisture, regardless of the numerous origins, left unchecked, will build up and cause extensive damage within the structure. Pot vents also work to lower heat buildup during the summer months.

Most pot vents consist of three main components, a flange or base portion, a conduit portion, and a hood portion. The flange is nailed to the roof deck over a similar sized hole as with the conduit portion. The leading edge of the flange is positioned over a course of shingles, while additional courses are laid over the flange and cut to fit around the conduit. The hood portion, which is rigidly attached to the flange, prevents moisture penetration in most cases. However, wind driven rain and snow tend to circumvent the infra-structure of the vent causing interior damage. Another common problem with pot vents is moisture seeping in around the conduit and following the now hidden tops of the shingles capillary fashion, and drips into the attic space again causing interior damage.

An additional problem with pot vents is bird nesting and pest infiltration. The hood of the pot vent creates a warm nest area for birds due to the thermal exhaust. To hinder this, some manufacturers incorporate a mesh screen. In many cases, it was found that not only did the screen fail, the birds actually used it to make their nest.

While another problem with pot vents is the aesthetic value once they are installed to a roof surface, many dwelling owners complain about the boxy square appearance of the vent. It is on the authority of the inventor that pot vent design has not significantly changed in the last 50 years.

Another product installed on pitched roof surfaces is the skylight. Skylights in general are installed on dwellings having a finished living area. The skylight lets in sunlight to the living area thereby reducing the need for electric light. Skylights in general are very expensive, both to purchase, and expensive to have them installed. Some skylights are inexpensive but constantly leak costing large sums of money to repair structural damage due to rotting wood. Skylights also have to be finished off from the inside of the home. This work requires a professional, and is normally too complicated for the average homeowner to install.

Therefore, given the current state of the art of venting and skylighting the infra-structure of a dwelling, this inventor has a new and useful invention having a main object of providing an inexpensive ventilator having a greater moisture and heat dissipating means while allowing the free introduction of sunlight into the dwelling. While attics are not visited often, they are used to store objects. Since there is a need to supply a lighting means to an attic, the free passage of light through a fully functional ventilator gives the present invention a new and useful purpose. Those who work out in the garage area have a great need to vent the work area of fumes. By getting a return of sunlight at the same value, the garage user can more efficiently make use of utility resources. The same objects apply to farm and ranch structures.

It is a further object of the present invention to provide a roof ventilator having greater moisture repelling capabilities by allowing the installer to shingle further over the flange thereby causing said moisture to travel a greater lateral distance before dripping behind the roofing material, by which time gravity has pulled the errant moisture down the flange and onto the apron and off the roof.

Another object of the present invention is to provide an installer with a two-piece ventilator which has the flange/conduit portion being installed first to the roof, and because the hood portion is multi-positional, has said hood portion snapped into place either square to the eaves, or diamond fashion, which would be consistent with a hip-roof design. The continued object of said hood is also to provide the skylighting function by incorporating a partially translucent upper surface which terminates into equally louvered walls.

While it is still a further object of the present invention to provide a ventilator that allows wind current passing over to draw a greater amount of exhaust from within the structure, regardless of wind direction, by having said wind create a negative atmosphere at the leeward side of the wind direction, said negative pressure creates a chimney effect.

Yet another object of the present invention is to provide an outer and inner flange of the skylight that can be simply installed without having to finish off the trim work typically done to the interior to facilitate the addition of such skylights to an interior ceiling. This object is met by having both flange members telescopingly communicate with each other such that regardless of the thickness of the cathedral ceiling, rafter, and roof deck structure, one collar of each flange will inner-lap the other thereby concealing the inner-structure of the above mentioned roof-rafter-ceiling assembly, which is unsightly. This object of the present invention will save the user a large sum over installing the prior art.

It is the final object therefore of the present invention to provide an embodiment of the translucent hood which can be retro fitted over the hole in the roof left by a non-functioning pot vent. Such situations occur when making the transition from pot vents to eave and ridge vents.

SUMMARY OF THE INVENTION

In light of the foregoing problems and to fulfill the above-stated objects, there is provided, according to one aspect of the invention, a combination static ventilator and a passive skylight for use on pitched roof surfaces. Said roof surfaces are most commonly encountered in residential architecture, as well as non-residential dwellings having a pitched roof surface.

In a main embodiment, the present invention consists of a two-piece ventilator/skylight. The components are formed from a UV stabilized composite material, and are installed to a pitched roof surface greater than a 3/12 ratio. The first component comprises a flange portion with a centrally extruding conduit. The conduit generally accounts for up to 60% of the surface area of the flange, and is a major factor in determining the net free area of the ventilator.

Prior to installing the above-mentioned component, an aperture of equal circumference is cut through the roof surface at the desired location for the vent. The roofing materials are installed, and using common ventilator installation methods, the flange/conduit component is rigidly fastened in place over said cut hole in the roof surface.

Located along the top perimeter of the conduit are a plurality of equally displaced indentures that terminate at a designated point down the outer wall portion of the conduit. These indentures are mated to receive a similar plurality of support studs located along the underside of the hood portion of the present invention.

The hood portion of the embodiment has a generally rectangular top surface with a circular translucent oriel centrally disposed thereat. When the components are rigidly mated, the oriel is in direct alignment with the conduit thereby allowing sunlight to illuminate the also now vented interior space. Located at the termination of the rectangular hood are downwardly sloped wall members which allow the normal passage of air through a plurality of louver openings located thereon. The louvers restrict the passage of moisture, however, by deflecting it away from the conduit opening once the wind or gravity driven moisture enters the air exchange area. The aforementioned studs, having a snap-locking feature matable to the nubular perimeter of the conduit, rigidly place the hood component of the present invention at a predetermined elevation. Said studs terminate at the point of communication between the oriel and conduit so as not to affect the inflow of light. The studs originate from a cylinder extending downward from the underside of the rectangular top portion of the hood to a point below the elevation of the conduit. Said cylinder, having a greater diameter than the conduit, allows air altered travel either in or out of the structure, but causes unwanted moisture to be dumped as it can't make the alteration due to the gravitational pull in the baffle area.

To prevent pest infiltration, a mesh is incorporated between the cylinder and conduit opening referred to as the free area. Said mesh can be formed from a composite material or from a metallic substance.

The components of the preferred embodiment can be joined either square to the eave, or the hood can be rotated 45% and rigidly snapped into place thereby creating a diamond appearance. This allows the installer greater mobility in designing the roof system.

There are advantages to being able to install the present invention in two pieces. One advantage is the ability to install the shingles in closer to the conduit. This will hinder the lateral penetration of moisture. The prior art has a rigidly attached hood mounted to the flange away from the conduit, and the shingle, or roofing material, must be notched to fit around the hood. Another advantage is being able to install the highly visible hood portion at the end of the roof work at hand so as to prevent marring and damage.

Due to the convex nature of the hood portion of the embodiment and the quadrally vented sides, air movement rising from the initial point of contact with the hood will create a negative pressure oppositely which will draw air from the vented space to compensate. This occurrence is exemplified regardless of the direction of the wind movement. The same air current moving over the present invention to create a negative pressure also applies force to the embodiment thereby holding it tighter to the roof surface. So the greater the air pressure, the greater the present invention is held in place. This is significant in high wind areas or hurricane zones where building components must meet ever stiffening building codes.

In another embodiment of the present invention, a solid flange having a centrally disposed oriel is installed over a pre-cut aperture in a pitched roof surface. The embodiment acts as a skylight only. There is a tremendous savings of money and work over installing the prior art. In some cases, pot vents are removed permanently to facilitate a new ventilation system, such as continuous eave and ridge vent. Instead of removing many shingles to replace the wood over the vent hole, one simply loosens the shingles around the hole and slides in the translucent flange.

Another embodiment of the present invention comprises a set of the aforementioned skylight only features, only these flanges have collars extending, one inward from the designated roof flange, and one outward from the now designated ceiling flange. The collars telescopingly communicate, with the ceiling flange collar residing inside the dominant roof flange collar. To install the embodiment, the roof flange is fastened to the roof after a hole has been cut into the substrate to accommodate the collar. This automatically places the oriel in alignment with the ceiling flange oriel. Shingles are then installed using existing roofing methods, which are compatible with all the embodiments of the present invention. From the inside of the dwelling the ceiling flange is set allowing the subordinate collar penetration into the dominant roof flange collar. The flange of the ceiling member is then fastened to the ceiling material. Due to the wide base area of the ceiling flange, the hole cut into the ceiling to allow the collar entry does not have to be precise. It is foreseen that the ceiling material could be installed over the ceiling flange to make the embodiment flush with the rest of the ceiling.

BRIEF DESCRIPTION OF THE DRAWINGS

In the drawings, where like reference numerals are used to indicate identical components in the various figures;

FIG. 4 is a dimensional perspective view of the embodiment as it would appear once the components are assembled.

FIG. 5 is a side elevation, in partial cross-section, of the preferred embodiment, slightly exploded. As viewed, an aperture is made into the roof deck consistent with the aperture of the conduit. The oriel/hood is shown prior to being mated to the flange/base portion.

FIG. 6 is a side elevation, in partial cross-section, of the preferred embodiment showing the support fins as in communication with guides located around the perimeter of the conduit.

DETAILED DESCRIPTION OF THE EMBODIMENTS

Figure 1:
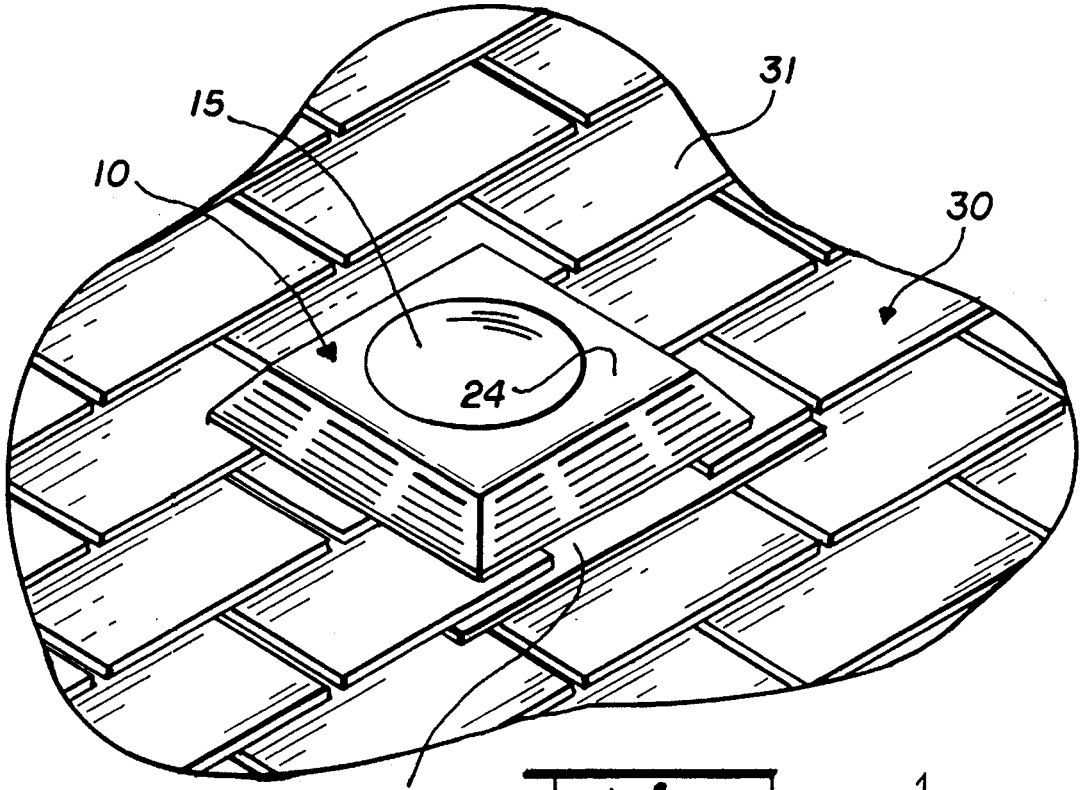
FIG. 1 is a perspective view of a preferred embodiment of the invention installed on a pitched roof surface. The present invention is shown in conjunction with the most common roofing material, a standard three-tab composition shingle.

With combined reference to all the figures, a combined skylight/static ventilator is generally denoted by the numeral 10. FIG. 1 shows the present invention 10 installed on a pitched roof 30. The base flange 22 of the invention 10 is rigidly nailed communicatingly with a roofing material 31 so as to allow precipitation to positively wash around the invention 10. Friction fitted to the base flange 22 is a hood component 24 which deflects precipitation out and downward from the invention 10. Centrally located through the top portion of the hood 24 is an oriel 15 which allows photonic penetration into the interior of a structure.

Figure 2:
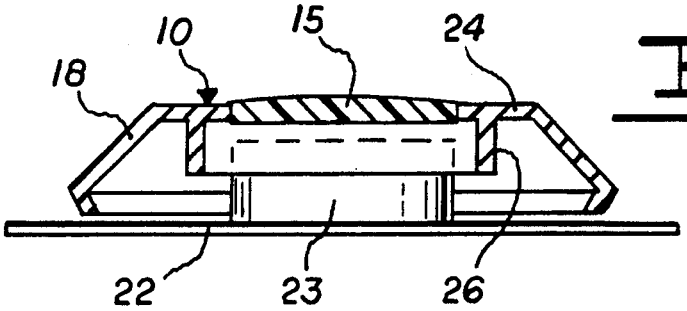
FIG. 2 is a side elevation, in partial cross-section, of the embodiment showing the flange/conduit portion in relation to the oriel/hood.

FIG. 2 shows the base flange 22 in relation to the hood 24 elevation. Centrally extending outward from the base flange 22 is a cylindrical conduit 23 which terminates at a predetermined elevation within the collar 26 section of the hood 22. Said elevation allows air to travel through the infrastructure of the present invention 10 and discharge from apertures located in the sloped walls 18 of the hood 24, and into the open. An oriel 15 is displaced, generally having a similar diameter as the conduit 23, thereby allowing sunlight to illuminate the area also now vented.

Figure 3:
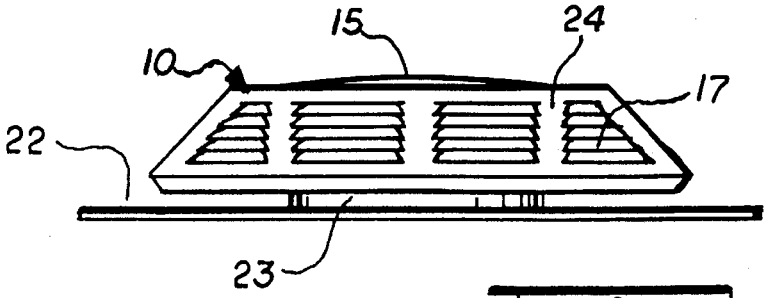
FIG. 3 is a perspective view of the embodiment showing the elevation of the oriel/hood to the flange base. Also viewed is an embodiment of the louver configuration.

FIG. 3 shows the invention 10, having a base flange 22 with a conduit 23 centrally disposed thereon, and connected internally to a hood member 24 for a purpose of venting a fluid through louvers 17 in the hood 24, and allowing sunlight penetration through an oriel 15 located within the top planer surface of said hood 24.

FIG. 4 shows the present invention 10 with the base/flange portion 22 mated to the hood/oriel member 24.

FIG. 5 shows a pitched roof substrate 46 having an aperture 37 cut there through to serve as a vent. Roofing materials 54 are installed and notched around said aperture 37. The base/flange 22, having a conduit 23 extend outward therefrom, is rigidly fastened through the roofing material 54 and into the substratum 46. The conduit 23 is generally in line with the aperture 37 thereby fixing the "net free flow" of air through the base/flange 22. At the termination of the conduit 23 is a nub 32. Peripherally displaced around the conduit 23, and extending to a midpoint of the conduit 23, are an equal and opposite number of guides 33 which receive support/lock studs 34 (as seen in FIG. 6). The hood/oriel member 24 is pressed down over the conduit 23 until the locking is complete. When the hood 24 is rigidly in place, said hood 24 will always be fixed at a set elevation. The wall structure 18, being quadrally sloped, assist air movement over the hood 24 which pulls exhaust from the opposite louvers 17 from the point of contact, by creating a negative atmosphere. At the termination of the wall structure are inverted deflector skirts 19 which also displace wind and precipitation uplift. Centrally located through the top of the hood 24 is an oriel 15 which is in communication first with conduit 23 and the roof aperture 37 thereby allowing for the solar illumination of the also now vented interior.

As seen in FIG. 6, the embodiment 10 comprises a top hood 24 having a plurality of walls 18 which terminate with an equal number of skirts 19. When rigidly fastened together with the base/flange 22, an oriel 15 is aligned to the conduit 23 thereby creating a skylight. The hood 24 is rigidly elevated by a plurality of supporting/locking studs 34 which snap in place over a nub 33 located at the top perimeter of the conduit 23. Said support/lock studs originate from a collar 26 within the hood 24. Said support/lock studs 34 are controlled from radial deviation by a plurality of guides 33 located around the outer wall of the conduit 23.

Figure 7:
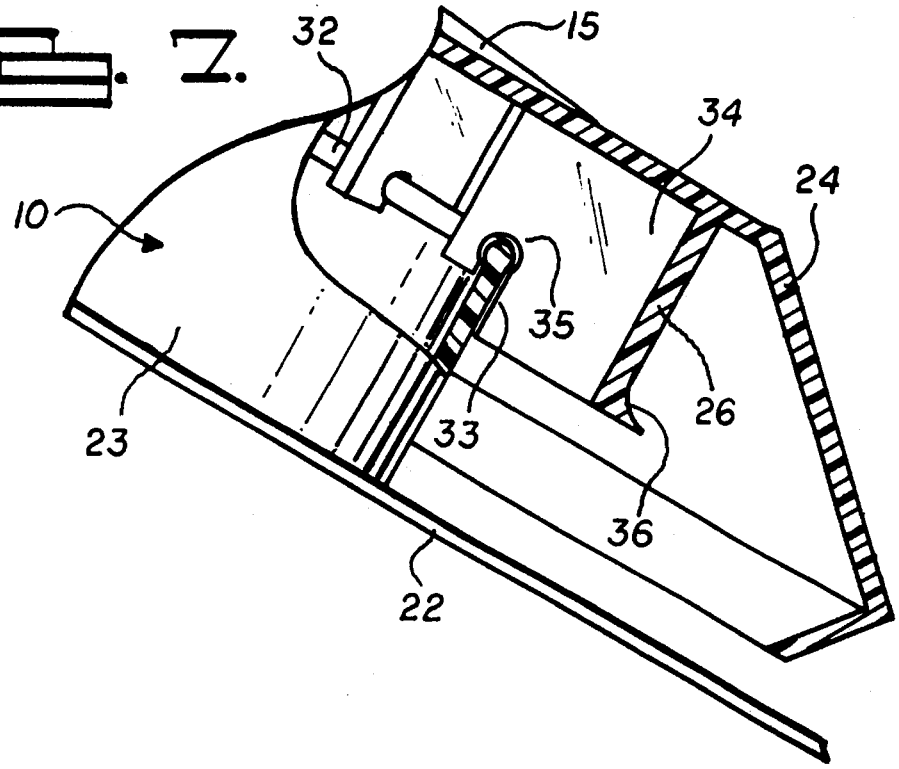
FIG. 7 is an enlarged cutaway view, in partial cross-section, of the support fin structure of the hood, as affixed to the conduit.

FIG. 7 is an enlarged detail of the support/locking studs 34. The present invention 10 comprises a first portion, the base/flange 22 and a second portion of the hood 24. As viewed, the studs 34 are aligned to grooves 33. Said studs 34 have a notch 35 located at the corner. The mouth of the notch 35 is slightly narrower than the width of the nub 32 located atop the conduit 23. The mouth of the notch 35 is forced to expand over the nub 32 and contracts once it is seated. The contraction of the notch 35 is what locks the two components in place thereby automatically aligning the oriel 15 to the conduit 23 opening. Situated around the termination of the collar 26 is a lip 36 which helps to deflect infiltrated moisture away from entry through the space between the support/lock studs 34.

Figure 8:
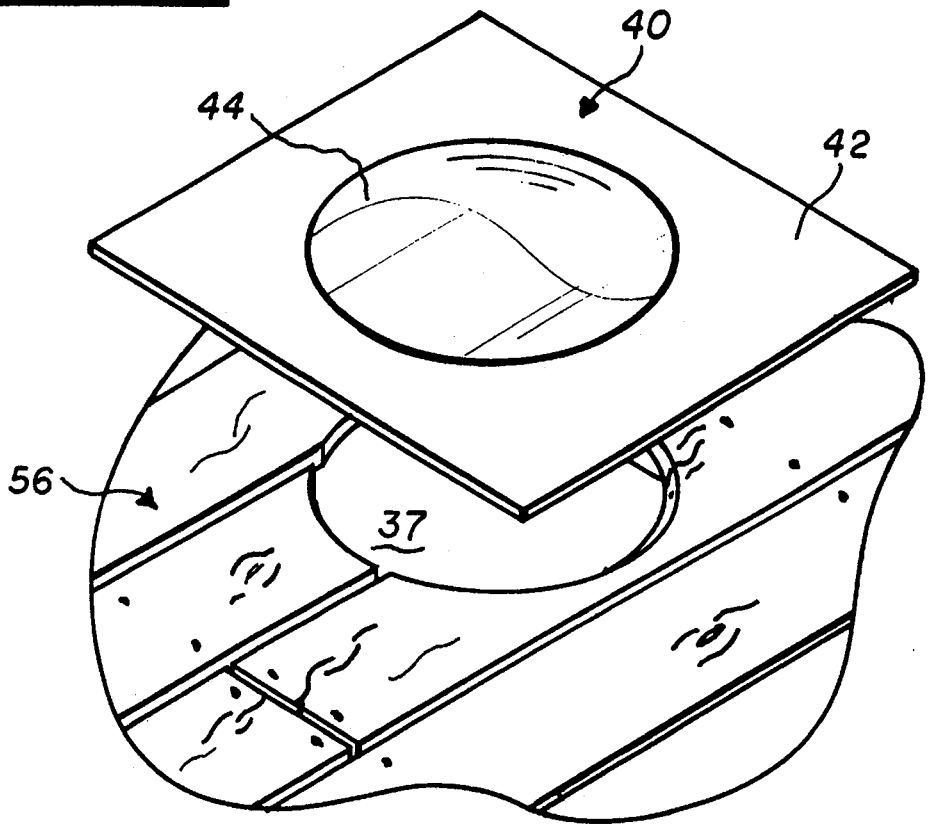
FIG. 8 is a cutaway perspective view of an additional embodiment of the present invention. As viewed, the embodiment of the oriel/hood portion is installed as a skylight. The view does not include the roofing material.

FIG. 8 shows an additional embodiment of the present invention whereas a skylight 40 comprises a flange 42 having an oriel 44 centrally displaced thereon. The oriel 44 is mated to a similar sized opening 37 in the roof deck 56.

Figure 9:
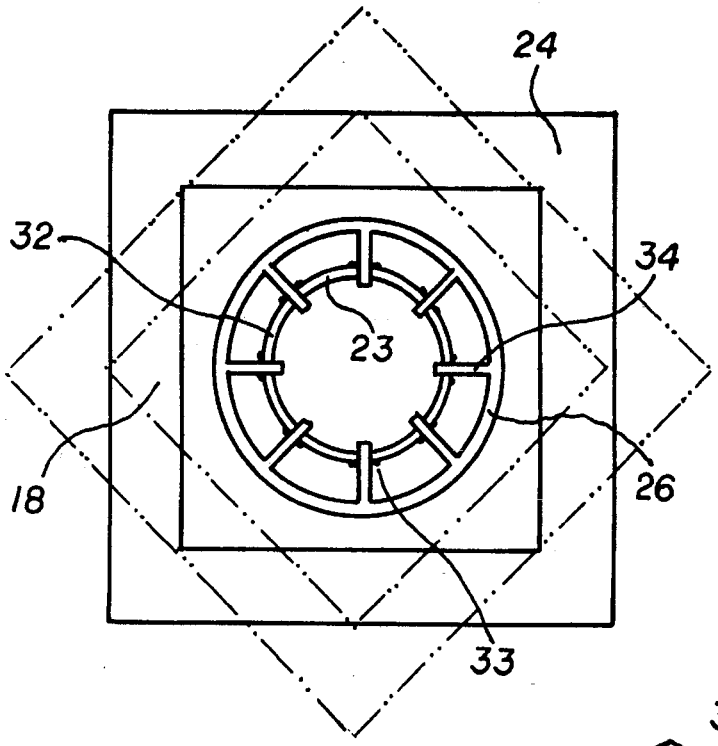
FIG. 9 is a top view, in cross-section, of the preferred embodiment as would be installed square to the eave. The phantom lines show the embodiment installed diagonal to the eave by rotating the hood 45%.

As seen in FIG. 9, the hood 24 is installed square to the ground by having a plurality of studs 34 lock onto a nub 32 located atop the conduit 23. By turning the hood 24 forty-five degrees either way, the hood can be installed diagonally as depicted through the phantom lines. The studs 34 extend from a collar 26 located centrally within the walls 18 and are prevented from lateral movement by a plurality of guides 33 displaced around the outer wall of the conduit 23.

Figure 10:
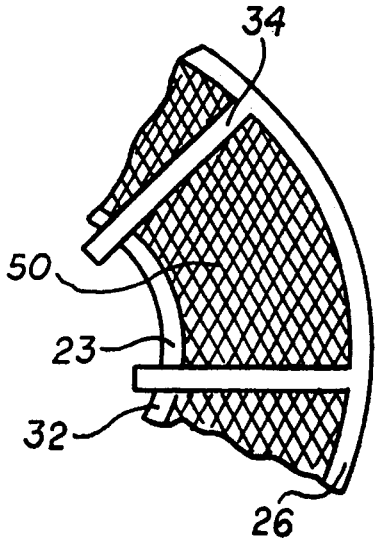
FIG. 10 is a cutaway perspective of the pest repellent means as attached to the collar of the oriel/hood and to the top perimeter of the conduit.

FIG. 10 shows a mesh 50 which is adhered to the collar 26 and the conduit 23 at a point below the nub 32. Said mesh 50 continues radially under the studs 34.

Figure 11:
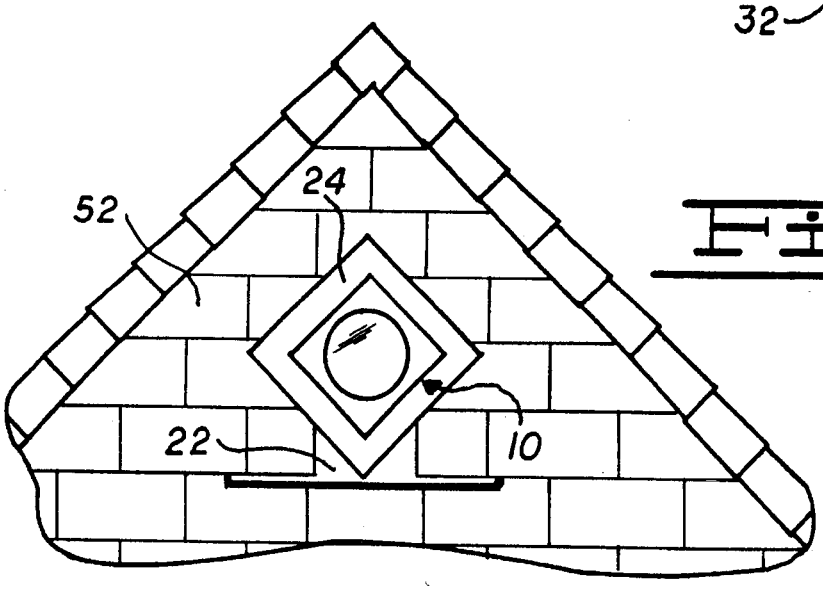
FIG. 11 is a top perspective view of the preferred embodiment as installed diagonally.

FIG. 11 depicts a roof 52 with the hood 24 installed diagonally to the base/flange 22 of the present invention.

Figure 12:
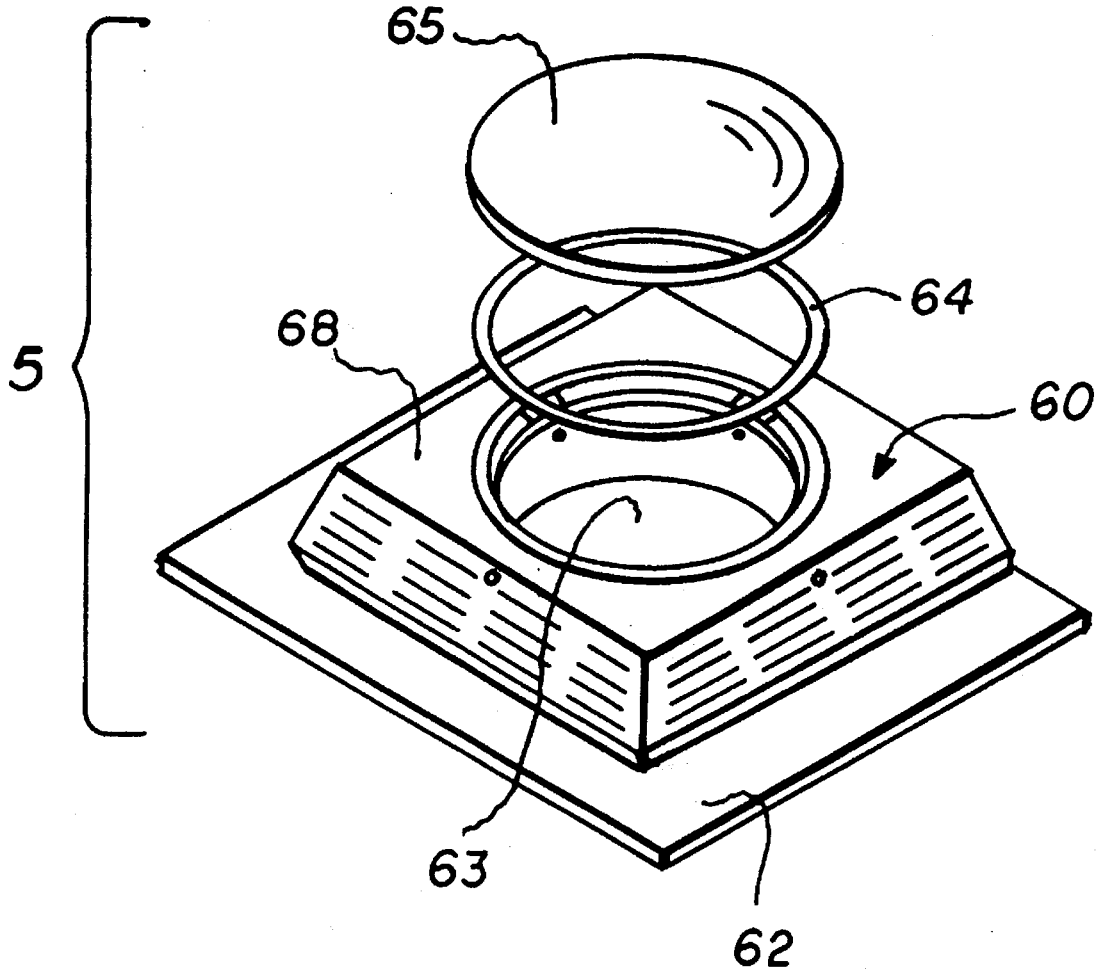
FIG. 12 is an exploded view of a metallic embodiment of the present invention depicting a means for securing a skylight feature into the ventilator.

As seen in FIG. 12, another embodiment of the present invention 60 is stamped from metal. The base 62 is rigidly fixed to the hood 68. As embraced by bracket 5, a gasket 68 is positioned around an aperture 63 located in the hood 68. A glass or polymer oriel 65 is then mechanically fastened over the gasket 64 and into the hood 68.

Figure 13:
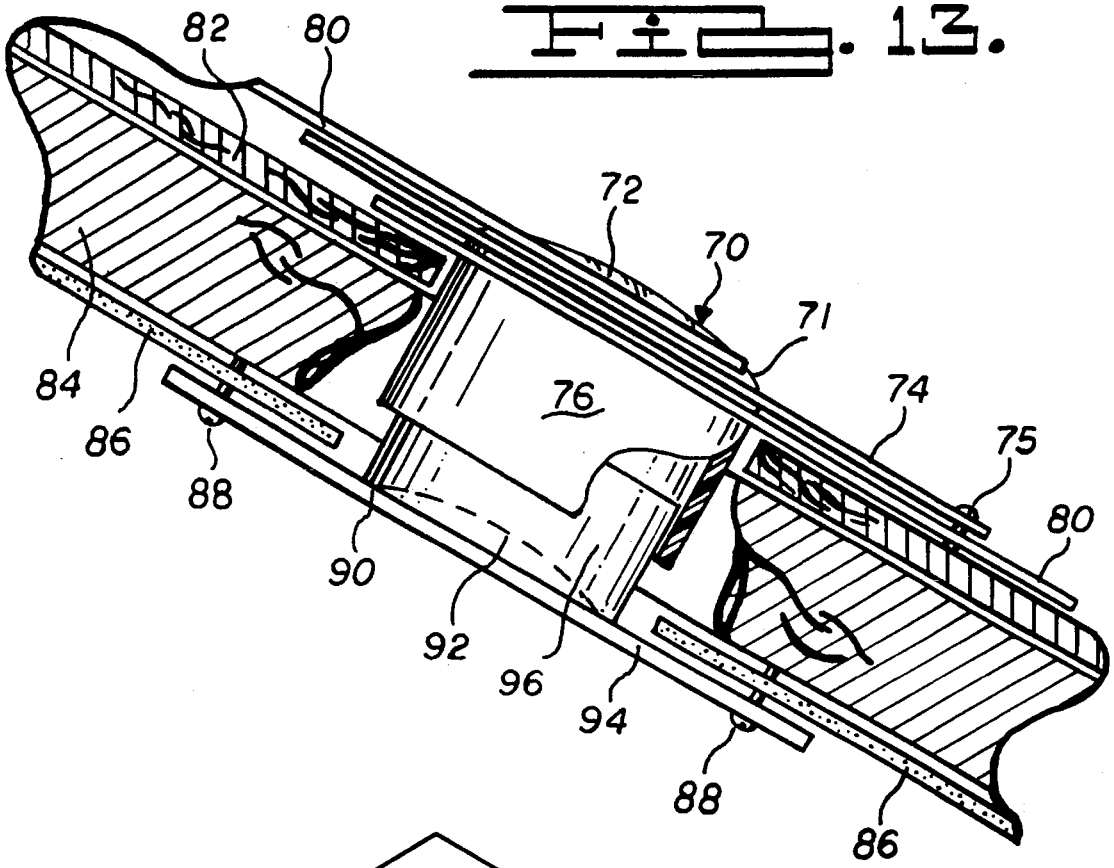
FIG. 13 is a fragmentary cutaway view, in partial cross-section, of the roof flange collar in communication with the ceiling flange collar. The view is slightly exploded to better illustrate the roofing material and the ceiling material.

FIG. 13 shows another embodiment 70 of the invention whereas a first skylight member 71, having an oriel 72 disposed through the flange 74 and centrally atop a collar 76. Said collar 76 extends inward through the roofing materials 80 and the roof deck 82, and is elevated there by roofing fasteners 75 installed through the flange 74 and into the deck 82. The roof deck 82 is fastened to a plurality of rafters 84, said rafters 84 having a ceiling material 86 fastened oppositely to form a cathedral type ceiling. A second member 90 of the embodiment 70 also has a flange 94 which is rigidly held to the ceiling using finish screws 88. Said member 90 has a collar 96 which is slightly smaller in diameter thereby allowing it to telescopingly interact with the roof member collar 76. Said ceiling member 90 also has an oriel 92 displaced so as to be in alignment with the first oriel 72.

Figure 14:
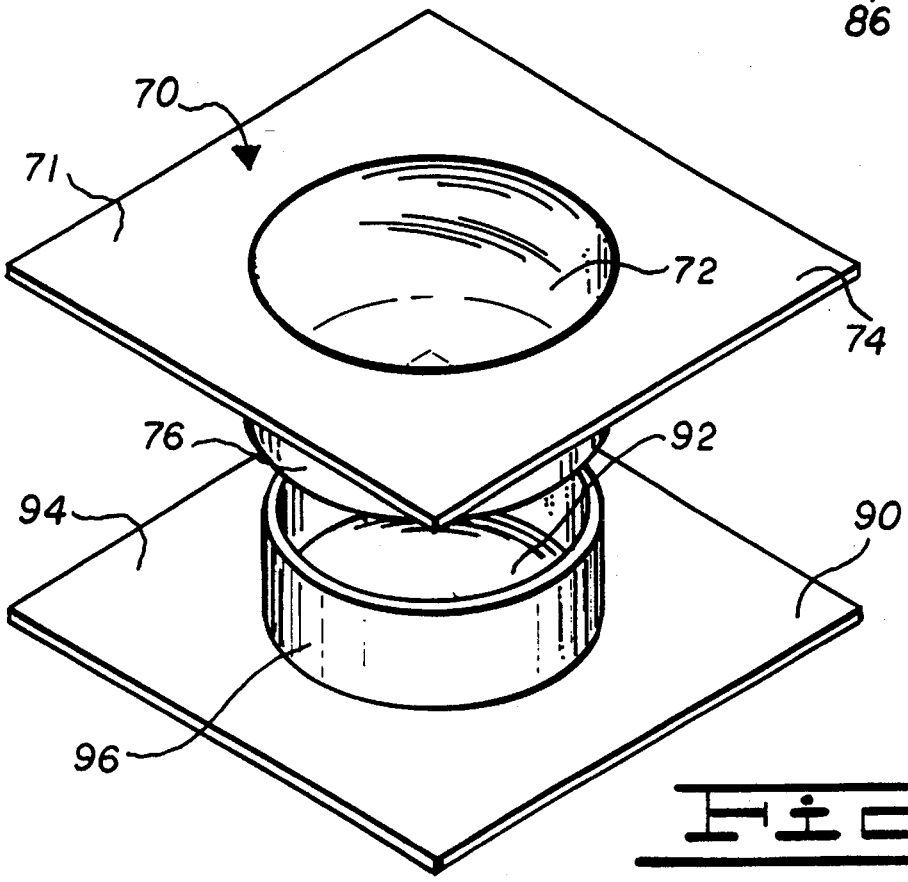
FIG. 14 is a perspective view of the roof skylight having a finished ceiling flange member.

FIG. 14 shows the embodiment 70 having a first top member 71 and a second bottom member 90. The collar 76 of the top member 71 is adapted to receive the collar 96 of the bottom member 90 thereby assuring the alignment of a first oriel 72 and a second oriel 92. The collars 76 and 96 then slidingly conceal the unsightly rafter space by being adaptable to a plurality of roof/rafter thicknesses. The collars are then held to that elevation by rigidly fastening each flange 74 and 94 to their respective substrates.

While the foregoing embodiments of the present invention are well suited to achieve the above-stated objects, those skilled in the art should realize that such embodiments are subject to modification, alteration, and change without departing from the scope of the present invention. For example, the louvers located in the hood structure could be replaced with a series of apertures and achieve the same results. As another example, the mesh pest barrier could be changed to a loosely porous fiber material.

Other variations will no doubt occur to those skilled in the art upon the study of the description and drawings contained herein. Accordingly, it is to be understood that the present invention is not limited to the specific embodiments described herein, but should be deemed to extend to the subject matter defined by the appended claims, including all fair equivalents thereof.

What is claimed is:

1. A combined static ventilator and skylight, for use on a pitched roof of a building, comprising:

a base member adapted for connection to the pitched roof, wherein said base member including a central opening and a conduit having an inner wall and an outer wall, said conduit radially attached to a flange portion which is adapted for attachment to the pitched roof;

a hood member having a translucent top portion, a top plate member having a cylindrical baffle member connected to said top plate member and extending vertically downward from said top plate member, and in alignment with said translucent top portion;

attaching means attaching said hood member to said base such that said translucent top portion is aligned with said central opening thereby conducting sunlight into the building while providing static ventilation there from;

wherein said attaching means including a plurality of equally displaced receiving indentures formed around said outer wall of said conduit, and a plurality of equally displaced studs attached to said baffle member and extending radially inward, wherein said studs are slidably received within said receiving indentures.

2. The combined static ventilator and skylight according to claim 1, wherein said flange portion has a central opening aligned with said conduit.

3. The combined static ventilator and skylight according to claim 1, wherein said hood member further comprising a plurality of side wall members connected to said top plate member and extending radially downward from said top plate member, said side wall members having louvers therethrough.

4. The combined static ventilator and skylight according to claim 3, wherein said side wall members extend from said top plate member at an angle conducive to creating a negative air pressure at a leeward area of said top plate member with respect to the direction of air current.

5. The combined static ventilator and skylight according to claim 1 further comprising a nub member attached to said conduit, said studs abutting against said nub member as said hood is inserted into said conduit, said studs having a notch for expandable placed over said nub member as said hood member is fixed to said conduit.

* * * * *